United States Patent [19]

Hystad

[11] Patent Number: 4,603,649

[45] Date of Patent: Aug. 5, 1986

[54] CLOSEABLE RESTRAINT FOR MAINTAINING A TOW LINE BETWEEN GUIDE PINS ON A BOAT

[76] Inventor: Per H. Hystad, N-4250 Kopervik, Norway

[21] Appl. No.: 636,157

[22] Filed: Jul. 31, 1984

[30] Foreign Application Priority Data

Aug. 17, 1983 [NO] Norway ..... 832963

[51] Int. Cl.[4] ..... B63B 21/02

[52] U.S. Cl. ..... 114/199; 114/218; 254/389

[58] Field of Search ..... 114/218, 242, 259, 251, 114/381, 199, 200; 254/389-391, 393-396, 398, 402, 403, 405, 407, 411, 413, 415

[56] References Cited

U.S. PATENT DOCUMENTS

| | | | |
|---|---|---|---|
| 557,984 | 4/1896 | Foran | 114/218 |
| 3,588,051 | 6/1971 | Leeming | 254/395 |
| 3,892,386 | 7/1975 | Hogan | 254/389 |
| 4,278,041 | 7/1981 | Williams | 114/218 |
| 4,347,800 | 9/1982 | Culver | 114/218 |
| 4,354,445 | 10/1982 | Kafka et al. | 114/218 |
| 4,423,697 | 1/1984 | Royset | 114/218 |
| 4,458,631 | 7/1984 | Hystad | 114/218 |

*Primary Examiner*—Trygve M. Blix
*Assistant Examiner*—Stephen P. Avila
*Attorney, Agent, or Firm*—Merchant, Gould, Smith, Edell, Welter & Schmidt

[57] ABSTRACT

Retractable tow line guide pins (1 and 2) at the stern of a tugboat or supply boat are made to be elevated from/-retracted into the deck (3) of the vessel and are also pivotable, such that over a portion of the raising or lowering movement they are pivoted 90°, whereby fixed locking members (4,5) mounted thereon and the pins themselves pivot from an inoperative position into a position in which the opening between the pins (1 and 2) is closed at the top, thereby preventing a tow line disposed in the opening between the pins from being released therefrom.

2 Claims, 4 Drawing Figures

CLOSEABLE RESTRAINT FOR MAINTAINING A TOW LINE BETWEEN GUIDE PINS ON A BOAT

The present invention relates to a locking means for the tow line guide pins on a tugboat, supply boat or the like.

Tugs and supply boats, especially vessels performing services for the offshore oil industry, are provided at the stern end of the vessel with tow line guide pins that can be elevated and retracted, used to keep the tow line from extending too far to port or starboard with the dangers this entails. The pins can be elevated and retracted, e.g. hydraulically, and are remotely controlled from the bridge or other safe position, permitting the pins to be raised to an elevated position when the tow line is properly positioned between the pins to constrain the tow line's lateral extension. The distance between the pins is about one meter and their height in the elevated position is normally about 80 cm above the deck.

At sea, due to wave motion, wind and weather, the tugboat or supply boat may sometimes assume a position relative to the vessel being towed which causes the tow line, extending from its fastening point on the boat, to be lifted higher than the top end of the guide pins, where it may jump free of these restraints. This sudden freeing of the tautly stretched line extending from the tow boat to the towed vessel has already been the caused of a number of injuries and even fatalities.

Obviously the line could be prevented from leaving the pins by providing some sort of locking mechanism. For example, a bar could be passed through holes at the top of both pins after the line is properly situated between the pins, but if this is to be done manually a crew member must enter the dangerous after-deck region, which involves such high risks that this must be avoided. The locking action must therefore occur automatically, and taking into account the forces of wind and weather to which a supply boat is subjected, the construction of the tow line guide pins and locking means must therefore be simple, robust, reliable and virtually maintenance-free.

A pair of tow line guide pins is positioned at the stern of the vessel, and in accordance with the invention at least one of the pins must be provided with a locking means which automatically closes the opening at the top of the tow pins by remote control. Preferably, each pin carries one-half of the locking means for the tow line, and as the pins are raised and lowered they are simultaneously pivoted, for example turned 90° during the final stage of the elevating movement.

Figure 4:
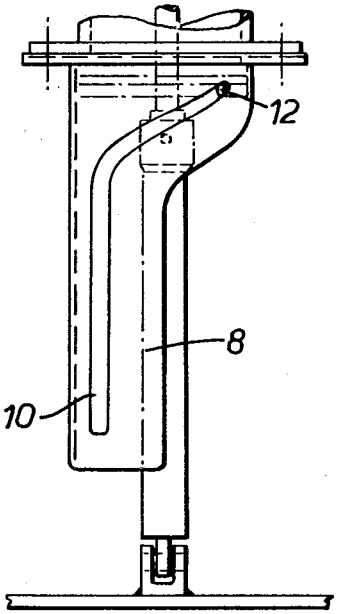
Figure 1:
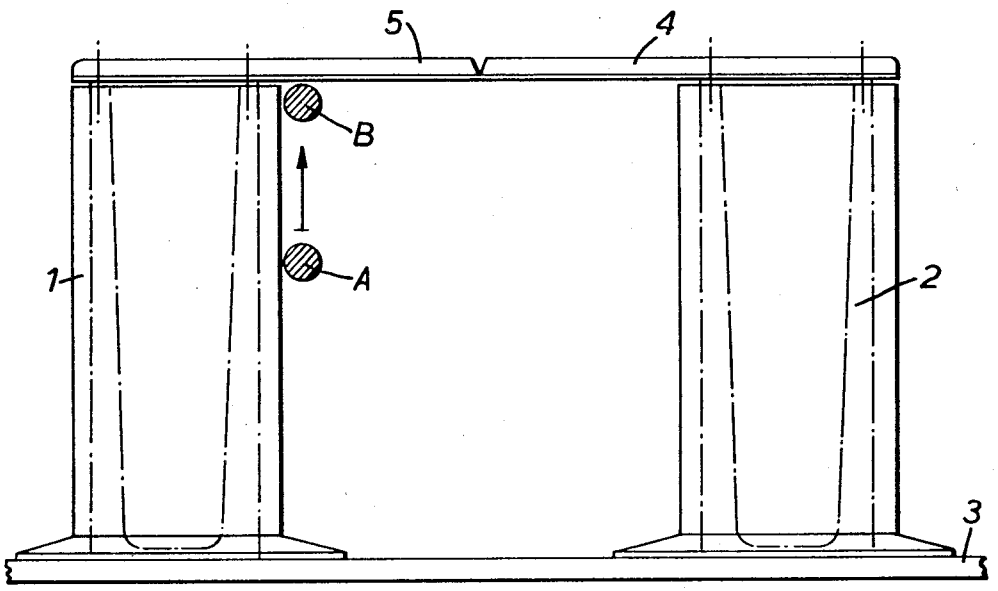
Figure 2:
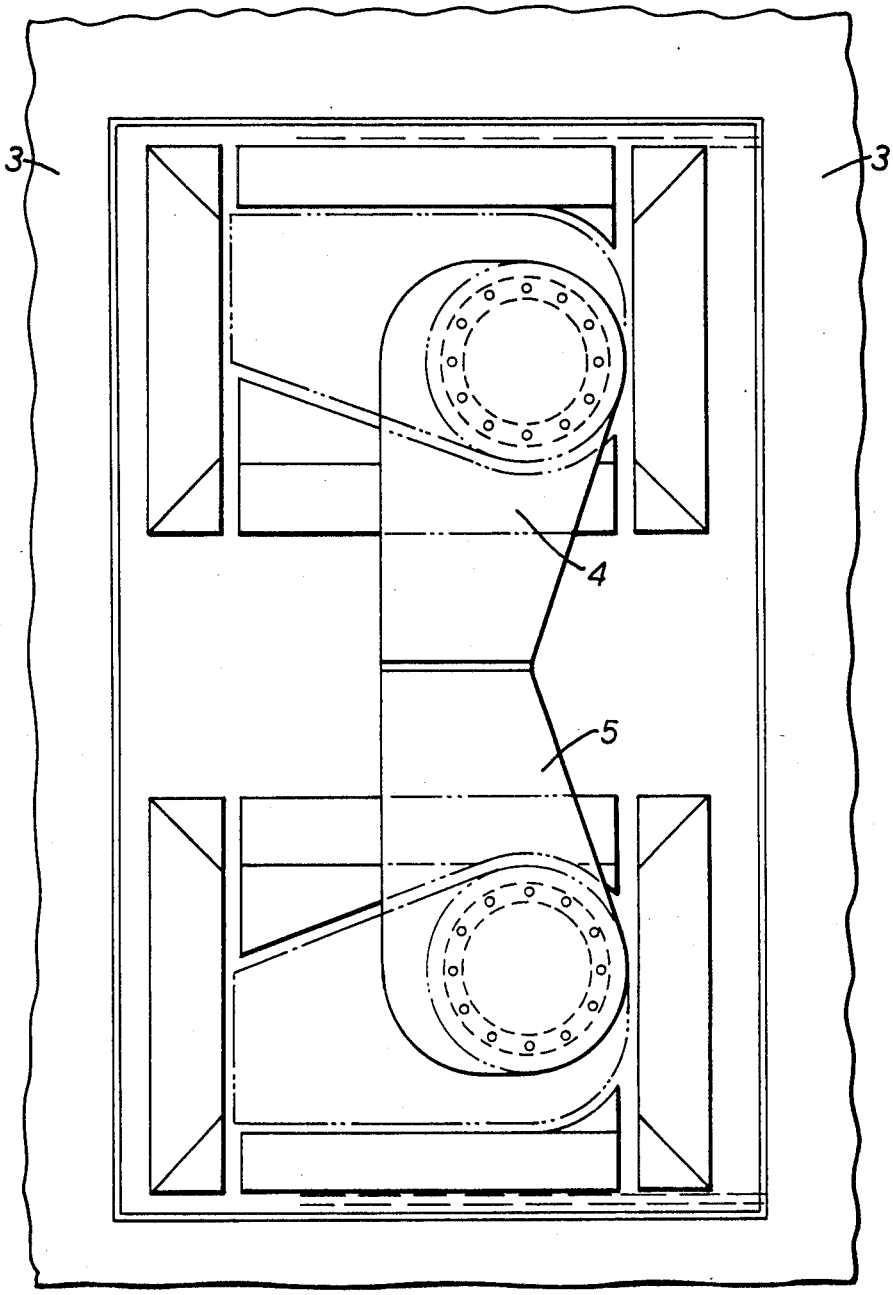
Figure 3:
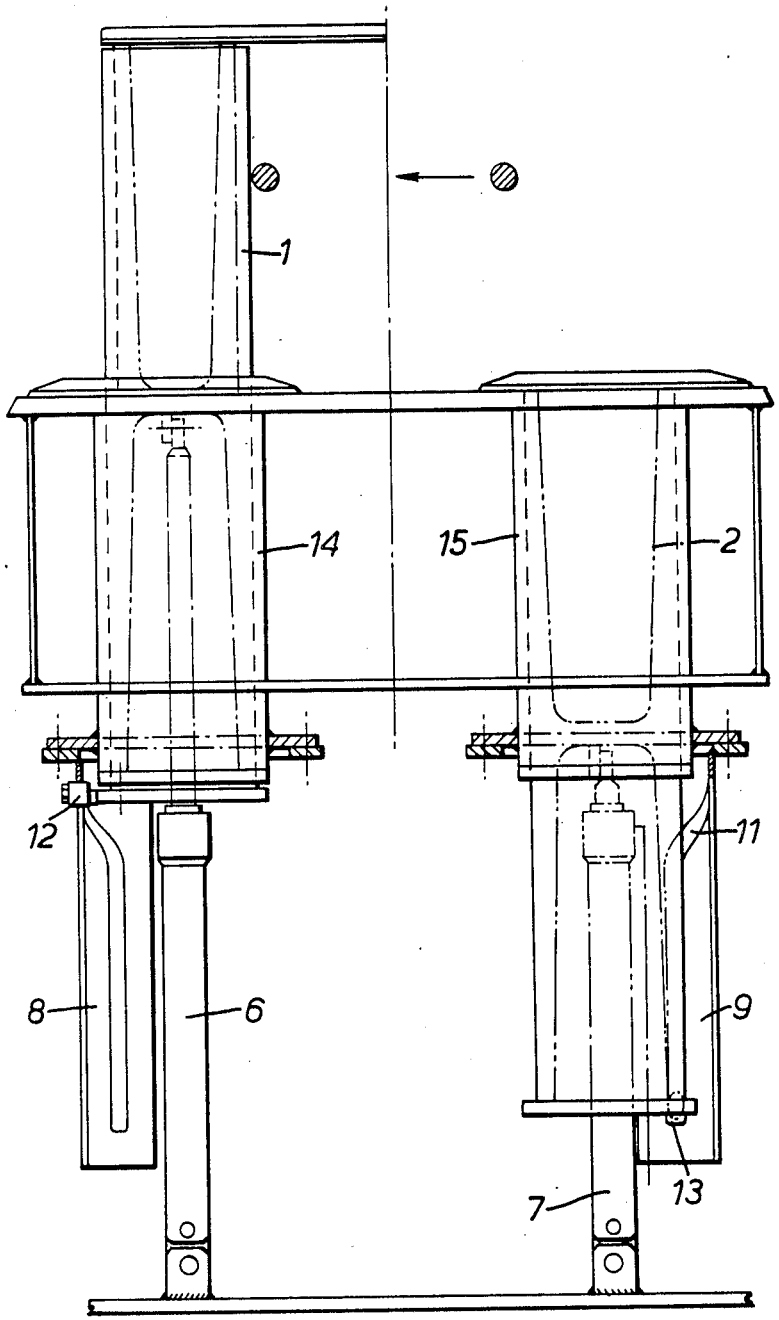

The invention is characterized by the features recited in the appurtenant patent claims and will be explained in greater detail in the following with reference to the accompanying drawings, wherein:

FIG. 1 shows a pair of tow line guide pins with a locking means for the tow line, looking in the direction of the stern of the tow boat, FIG. 2 shows the pair of pins with the locking means as seen from above, and FIGS. 3 and 4 show details of the exemplary embodiment chosen to illustrate the invention.

FIG. 1 shows two tow line guide pins 1 and 2 which are adapted to be elevated from and retracted into the deck 3. At the top end, each pin carries a projecting locking member 4,5 for closing the opening between the pins 1 and 2. The normal position of a tow line is shown at A, but under the unpredictable conditions pertaining in waters such as the North Sea when a supply boat is towing a vessel to offshore oil installations, the tow line could assume the position shown at B. If this occurs, the locking members 4 and 5 will prevent the line from jumping free of the guide pins.

The shape of the locking members 4,5 may be seen in FIG. 2, where the tow line guide pins are viewed from above, the solid lines showing the pins in the elevated positions and the broken lines showing the position of the locking members 4 and 5 when the pins have been retracted into the deck 3.

In the illustrated example, the locking members 4,5 pivot 90°, as seen in FIG. 2, and although this rotation can be accomplished in various ways, an especially practical and robust solution is illustrated in FIGS. 3 and 4. In FIG. 3, one tow line guide pin 1 is shown in the elevated position and the other pin 2 in a lower position. Remotely controlled hydraulic cylinders 6 and 7 raise and lower the pins as required, and the 90° turn of the pins and thereby of the projecting locking members 4,5 is produced with the aid of a tubular segment 8,9 connected to a respective pin 1,2. The segments 8,9 have respective guide grooves 10,11 and each guide groove cooperates with a roller stud 12,13 at the lower end of each pin 1,2. As seen in FIG. 4, the groove 10 follows a straight line over a substantial portion of its length, for example 60 cm or more, while the groove is laterally deflected over the remaining 20 cm of its length, assuming the pin can be moved a total distance of 80 cm. The upper, deflected part of the groove, as seen in FIG. 4, is of sufficient angle of inclination and length to cause the pin, by means of the roller stud 12 which follows the groove configuration as the pin is elevated, to pivot 90° from the position shown with broken lines in FIG. 2 to the position indicated by the solid lines. The pins 1,2 slide as shown in FIG. 3 within robust guides 14,15 and can be retracted below deck level, and the guide means consisting of the segment 8, groove 10 and stud 12 are also located below deck, well protected from wind and weather. With this simple construction, one obtains great reliability combined with simple maintenance.

The embodiment illustrated herein is merely an example of how the idea of the invention can be realized, and there are several other ways of bringing about the rotary movement, e.g. utilizing hydraulic equipment operated from the bridge for pivoting the pins, causing the projecting locking members to pivot from the locking position to a position for releasing the tow line.

I claim:

1. A closeable restraint for maintaining a tow line between a pair of guide pins on a boat, comprising:

a rotatable locking member on each of said pins at the upper end thereof, said locking members each being rotatable toward each other to define a barrier across the upper end of said pins when closed, and means for raising and lowering each of said pins, rotary means connected to each of said pins and responsive to the movement thereof for opening and closing said barrier; said rotary means each including a stationary member and a tubular segment, each of said tubular segments having a guide groove therein which follows a generally straight vertical path and then a laterally deflected path toward the upper end thereof, said grooves of the tubular segments being mirror images of each other, said stationary member engaging said groove, and causing said tubular segment to rotate as it tracks said groove, one segment clockwise and the other counterclockwise, thereby operating said locking member.

2. The restraint according to claim 1 wherein said means for raising and lowering of each of said pins is operated simultaneously for each of said pins.

* * * * *